US005525253A

United States Patent [19]

Gamblin

[11] Patent Number: 5,525,253

[45] Date of Patent: Jun. 11, 1996

[54] LAUNDRY DETERGENT SYSTEM

[76] Inventor: Rodger L. Gamblin, 8 Springhouse Rd., Dayton, Ohio 45409

[21] Appl. No.: 327,600

[22] Filed: Oct. 24, 1994

[51] Int. Cl.[6] ..... C11D 9/10; C11D 3/04; C11D 7/00

[52] U.S. Cl. ..... 252/108; 252/109; 252/135; 252/DIG. 11; 252/DIG. 14

[58] Field of Search ..... 252/108, 109, 252/135, DIG. 11, DIG. 14

[56] References Cited

U.S. PATENT DOCUMENTS 3,619,115 11/1971 Diehl et al. ..... 8/137
4,566,984 1/1986 Bush ..... 252/140
4,647,393 3/1987 Ouhadi et al. ..... 252/102
4,973,419 11/1990 Romeo et al. ..... 252/135

*Primary Examiner*—Glenn A. Caldarola
*Assistant Examiner*—Patricia L. Hailey

[57] ABSTRACT

A laundry detergent system is described that comprises a chelating agent and ordinary soap. The chelating agent acts in the triple capacity of softening the water used for washing, buffering the wash water to a alkaline pH, and preventing soil redeposition.

1 Claim, No Drawings

LAUNDRY DETERGENT SYSTEM

RELATED PRIOR WORK

This invention, in part, is similar in concept to a previous invention, U. S. patent application Ser. No. 08/274,426, filed Jul. 11, 1994 and to a co-pending application of even date herewith, entitled, "Shampoo Formulation". This invention relates to laundry detergents.

BACKGROUND OF THE INVENTION

RELATED PRIOR ART

In this application I shall use the word "soap", or if there is possible ambiguity, "ordinary soap", to describe the salt of an alkali metal or amine and a fatty carboxylic acid. Prior to the 1950's most agents added to water for the washing of laundry were based upon ordinary soap. In the 1950's major manufacturers throughout the world introduced detergent systems based upon synthetic detergents (syndets) for the washing of laundry.

Shortly after their introduction, such systems came to dominate the market for laundry detergents. There were a number of reasons for this rapid acceptance. At the time alkylbenzene sulfonic acid (ABS) had been discovered. This material is outstanding as a detergent, when properly formulated, and, at the time, was both inexpensive, and environmentally acceptable.

Later, in the 1960's, it was found that ABS is so persistent in the environment that it tended to cause streams and lakes to foam. This lack of biodegradability was identified as arising from the branched side alkyl chain of the ABS and was rectified (achievement of about 80% biodegradability) by using a liner alkyl side chain. Thus LAS, which stands for linear alkylbenzene sulfonic acid, replaced ABS. Detergents based upon this material dominate the world market at present.

Laundry detergent systems are not just a detergent and water, however, and involve considerable subtlety in their formulation. Because it is hard to motivate the present invention without some discussion of these formulations, such systems are briefly described.

LAS foams well and does not precipitate in hard water, however, it is not so effective a detergent as when used with soft water. The reason for this difference is that multivalent ions in the wash water adhere to and modify the surface charge of the clothes being washed so as to prevent proper lifting of soil from the fabric.

LAS in soft water is effective at removing soil, but is not so effective at preventing redeposition. As a result additives that prevent such redeposition, in particular, carboxymethylcelluloses, are routinely added to detergent formulations.

Many washing machines use aluminum components. Such components are chemically somewhat fragile, so that it is normal to add some sodium silicate to a laundry detergent system to prevent corrosion of the aluminum parts. The silicate, under the alkaline conditions of the wash water, forms an impervious coating of sodium aluminum silicate on the aluminum that prevents further attack. Currently plastic parts are being used more and more, however, so that, in time, it is anticipated that requirements for silicate will disappear.

Finally it is generally true that LAS when combined with about twenty percent of its own weight of a nonionic surfactant becomes especially effective for cleaning. Though it is possible to base a detergent system on either a nonionic or LAS, this particular combination is more effective than either alone and costs less since less detergent is required.

In summary, a detergent system ideally consists of a detergent combination, but mostly LAS, a water softener, usually a polyphosphate or zeolite in the United States, sodium silicate, carboxymethylcellulose, and a little perfume and perhaps some fluorescing dye (to dye the clothes whiter than white). Such systems may be supplemented by the inclusion of salts such as sodium sulfate to bulk out the detergent and to modify the ionic strength of the water in the wash. Such a modification is reputed to be helpful in the detergentcy of a system.

Very recently it has become fashionable to reduce the amount of material that must be added to the washing machine to do a load of laundry. As a result laundry detergent systems have had to dispense with any extra material and present day detergents may have reduced levels of all but the most key ingredients. With present liquid systems, some detergents have eliminated the water softening agents altogether, probably to the detriment of the cleaning ability of the system. Presently about 60 grams of detergent are used per medium load of wash in the United States.

Within the past two decades, it was found that by combining soaps with somewhat lesser amounts of certain detergents, which, when so used, are called lime soap dispersants, ordinary soap can be used in hard water. With most lime soap dispersants, the amount required depends on the hardness of the water and the amount of water used. In at least one case, that of certain sulfobetaines, the soap and lime soap dispersant need only be mixed in certain proportions and the combination is effective in almost any hardness at any dilution. This approach to using soaps is being used by some individuals at present, primarily for environmental reasons.

In spite of extensive work with detergent systems over the past years, some defects remain. Generally present day detergents leave clothes with a harsh handle, that is, hard and boardy and with a coarse feel, and with considerable static cling. As a result materials have been developed that may be added to the wash or dryer that soften clothes and eliminate static cling. Generally the materials that perform this function are certain fatty quaternary amines that surface treat fabrics and impart a softer feel. They also give better static discharge characteristics.

Over the years syndets have become relatively more expensive compared to soaps. The increase in cost of petroleum products compared to natural fats and oils, and the cost of the LAS as compared to ABS have caused this change. Syndets are only about 80% biodegradable and though such a level permits their use at present, future population growth may change the present picture in the United States. In some places, an example being Niagara Falls, present levels of stream contamination are giving problems with stream foaming.

BRIEF SUMMARY OF THE INVENTION

Most of the problems associated with present day use of detergents could be solved by switching the basic surfactant in the detergent from syndets to soap. Soaps do not give a harsh handle to fabrics and are essentially completely biodegradable. Such an idea may appear obvious, however, soaps suffer from two fundamental problems that inhibit their use at present and which were responsible for the switch to syndets in the first place.

Soap precipitates in hard water. In such a situation soap not only loses any effectiveness as a cleaning agent, but becomes part of the problem. Soap precipitated by calcium, magnesium, or iron forms a sticky residue that itself is a soiling agent. Secondly, soap is subject to a decay in performance if it comes in contact with acids. Fatty acids themselves are weak and thus precipitate at a pH only slightly lower than neutral.

This invention relates to a system that combines soap with certain chelating agents. Preferred realizations of this combination unexpectedly gives rise to a system that works well in soft and cold water, has good alkaline reserve to prevent sensitivity to acids, is near 98% biodegradable, prevents redeposition in the wash, leaves clothes with a soft handle, is very inexpensive and efficient and cleans better than conventional syndet based materials. Furthermore the system is less expensive than conventional detergents and uses less physical material to perform the function of washing. This latter fact, especially when combined with the information that the system is at least 98% biodegradable, attests to its environmental desirability.

Specifically, the preferred implementation of this invention comprises a combination of trisodium nitrilotriacetic acid, ordinary soap, and, optionally, small amounts of sodium silicate, perfumes, colorants, fluorescing dyes, and so forth. Water soluble materials that bulk out the detergent system so that essentially more needs to be used, may, of course be added, provided enough material is used in each wash load to maintain the required level of essential ingredients.

Surprisingly this combination of ingredients suffices for the achievement of the objectives sought with a good detergent system for laundry. Nitrilotriacetic acid (subsequently referred to as NTA) is not only an effective and powerful chelating agent so that it permits the use of soap in hard water, but, in addition, prevents the redeposition of soil onto clothes during the wash cycle. A detergent system based upon NTA and soap produces an extraordinarily clean wash.

NTA's third acid group is a weak acid so that its third sodium ion is a effective buffer for the laundry pH. Thus the second vulnerability of soap, that is sensitivity to acids is overcome.

Perhaps the most surprising finding associated with the use of NTA with soaps is that it permits tallow soap to be used in cold water. It is a given in the literature, and a finding in my laboratory, that tallow soaps, even when reduced to a flowable powder, do not adequately dissolve in cold water during a normal wash cycle. When sufficient NTA is included in the water to soften it completely, ie. better than a mole equivalent to the hardness in the water, the soap dissolves in only a few minutes of the wash cycle. The reason for this surprising result has not been determined. It is suspected that under conditions normally found with ordinary hard waters, enough insoluble soap forms on the surface of grains of soap so as to prevent ready dissolution of the soluble soap underneath.

NTA is remarkably inexpensive. It may be produced from equimolar portions of ammonia, sodium cyanide and formaldehyde, with the latter two both being inexpensive feedstocks. Alternatively it may be produced from hydrocyanic acid and formaldehyde that is subsequently treated with sodium hydroxide. This latter route uses slightly lower cost feedstocks, and produces acleaner product. Ammonia is a byproduct of the manufacturing process and, of course, then need not be a feedstock. The molecular weight of trisodium NTA monohydrate is only about 275 Daltons and it is effective on an equimolar portion of hardness ion. It is thus unsurpassed in its weight effectiveness as a chelating agent.

Based upon experience in Europe, most notably in Switzerland, NTA is about 98% biodegradable. This attribute is not shared to the same extent by most other of the common chelating agents except for the polyphospahtes.

In the United States NTA has been approved by the EPA for uses that include home laundry. Presently NTA, as mentioned above, is approved for use for the same purpose in Canada, Switzerland, the Netherlands and some other countries. It is to be expected that as time goes by the list of countries that approve the material for use in laundry will increase.

Presently tallow soap is less expensive than LAS, and likely to grow even less expensive on a relative basis in the future. Furthermore, in the right environment, specifically in perfectly soft water, soap is more effective than LAS as a cleaning agent. Typical tallow soaps have average molecular weights of slightly less than 300, while LAS sodium salt is about 350.

Finally soap imparts a soft handle to clothes wheras LAS gives a harsh feel. With the latter materials, fabric softeners are highly desirable, while with soaps they are seldom required. Fabric softeners are expensive.

Soap, being the alkali metal salt of a natural fatty acid, is highly biodegradable. Whatever soap survives to the water treatment plant is immediately precipitated by any alum treatments to desludge the water. NTA has been extensively used with syndets in Canada and Switzerland. Extensive animal testing of the toxicity of NTA has shown no problem with the material.

DETAILED DESCRIPTION OF THE INVENTION

This invention comprises 5–80% of the alkali metal or amine salts of certain chelating agents, 20–95% of ordinary soap, and, optionally, 0–20% of an alkali metal salt of silicic acid. In addition to these ingredients, optionally, other minor ingredients such as perfumes, dyes, and bleaches may be added. It is also an option to add water soluble materials that dilute the more expensive main ingredients. Such materials might include, for example, more sodium silicate, sodium sulfate, sodium carbonate, borax, sodium chloride, various phosphates, and so forth. Generally speaking diluents serve to reduce the per pound cost, but add little to the cleaning power of the system so that more material must be used to wash a given amount of clothes.

The purpose of any formula for doing laundry is, of course, to achieve certain levels of active ingredients in the bath that actually washes the clothes. As will be described in more detail below, it is essential to the function of this invention to chemically chelate all hardness in the water used for the laundry. This implies that enough chelating agent be present so that there is at least one molecule of such an agent for each molecule of hardness.

Hardness levels range from a three parts per million in homes equipped with efficient water softeners to perhaps 350 ppm in desert regions of the world. Since the most efficient common chelating agent has a molecular weight of 275, about 275 ppm of chelator is required for 100 ppm of hardness, the range of required chelating agent might be from about 10 to 1000 ppm.

The amount of soap required in a laundry bath is somewhat subjective. In perfectly softened water, clothes are cleaned quite effectively with no soap in the bath. On the other hand the inclusion of soap leads to cleaner clothes, less sensitivity to impurities brought in with the bath, and to softer and better looking laundry. The amount does not appear to be very critical, but, in accord with time-honored practice, maximum cleaning seems to occur with light levels of foam in a soap system. I have found that a minimum level appears to be about 20 ppm while the upper level is not critical and can be as high as 3000 ppm.

The natural soap portion includes the water soluble basic salts of various fatty carboxylic acids. By soluble is meant that at least 20 milligrams per liter of the particular soap must dissolve in water at room temperature. By fatty carboxylic acid is meant a carboxylic acid moiety connected with a relatively long aliphatic hydrocarbon chain. Such fatty acids for soaps, at least in the United States, are derived almost exclusively from natural sources and conventionally are saturated or unsaturated linear C6–C22 carbon chains with the acid group at the molecule end. An exception is rosin which has a relatively complex C20 unsaturated acid as its main constituent. Another is the major fatty acid derived from castor oil that has a hydroxyl on its carbon chain, as well as an unsaturation.

Generally the soaps useful for purposes of this invention include the soluble basic salts of C6–C22 linear fatty acids. The most common saturated fatty acids for soap are C12–C18 acids named, starting at twelve and going by even numbers to eighteen, lauric, myristic, palmitic, and stearic. The most common unsaturated acid is oleic which is a C18 fatty acid with a cis double bond in the ninth position. Oleic acid is the most widely distributed fatty acid in nature and is a major constituent of most animal or vegetable fats. The second most common unsaturated fatty acid is called linoleic acid and has two unconjugated double bonds, both in the cis configuration with one on the ninth and the other on the twelfth carbon.

The least expensive fatty acids in the United States are those derived from animal sources, most usually beef and pork fat. The bulk of the actual fatty acids from these sources are oleic, palmitic, and stearic acids. These fatty acids are generally stable enough against oxidation so that they form stable soaps when neutralized. Other sources of fatty acids that are useful for purposes of this invention include palm oil, coconut oil, palm kernel oil, hydrogenated vegetable oils, vegetable oils, navel stores (tall oil products), castor oil, and other animal fats.

The preferred fatty acids for purposes of this invention include those from tallow, grease, vegetable oils and navel stores. The most preferred fatty acids are those derived from tallow and grease because of their cost and availability. Such materials are generally limited to use in powdered formulations, however, since even their potassium salts are too insoluble in water to permit a liquid formulation.

In the case of liquid systems, materials such as rosin, liquid vegetable oils, and coconut or palm kernel oil fatty acids are most useful. Of these the most preferred are the short chain saturated fatty acids from coconut and palm kernel oils because of their stability against oxidation.

Unsaturated oils may be used, of course, but a formulation must contain a portion of some antioxidant such as, for example, a hindered phenol, in order to prevent the development of rancidity. There are many agents that may be used as anti-oxidants, and such agents are readily available commercially. A good reference is Kirk-Othmer, *Encyclopedia of Chemical Technology, 3rd Edition* (John Wiley & Sons, New York, N.Y.), Vol. 3, pp. 128.

The base used to form the soap of this invention can include the alkali metals and various amines. Traditionally, soaps have been formed from the alkali metal salts of fatty acids, specifically the sodium and potassium salts. The latter are much more soluble than the former in water.

In laundry detergents formulated as dry powders the sodium salt is preferred because of its physical hardness, low cost and stability. In the case of liquid formulations, the potassium salt is usually required to achieve enough water solubility to permit use of reasonable amounts of soap and chelating agent in a water based liquid. For use with ordinary laundry, the alkali metal salts are most preferred, however, special soaps must be used with woolens, silks and other fine fabrics that are alkali sensitive.

Alkali metal salts, in the case of near complete neutralization of the fatty acid, are quite basic, since the fatty acid is relatively weak and the base quite strong. To overcome this problem without, at the same time, decreasing the stability and effectiveness of the soap, the potassium and sodium salts may be combined with weak amine salts to produce a system with both reasonable stability and relatively low pH. Such soaps are suitable for wool or silk.

In such cases generally the alkali metal salt constitutes greater than 80% of the soap, but the rest is a weak amine salt. It also is generally desirable to provide for an excess of the amine salt over stoichiometry to both act as a buffer for the system and maintain the pH at an optimum level.

By weak amine salts are meant various ammonium compounds. Ammonia itself suffers not only from the fact that it is volatile, so that its presence in the system may be somewhat transient, but also is highly odoriferous, so as to detract from the system's esthetic value. Ordinary aliphatic or aromatic hydrocarbon amines tend to be both odorous and toxic, and thus are not preferred. Amino alcohols, and alkanolamines as described, for example in Kirk-Othmer, *Encyclopedia of Chemical Technology, 3rd Edition* (John Wiley and Sons, New York, N.Y., 1978) Vol. 1, pp 944, are the preferred materials for this invention. The most preferred amines are triethanolamine and triisopropanolamine.

Chelating agents that may be used with this invention are materials that act to powerfully prevent precipitation of the insoluble salts of polyvalent ions, found in normal hard water, with fatty acids. Though there are many such agents inclusive of zeolites, hydroxy acetic acids, and so forth, the most effective agents are the polyphosphoric acids, the amine or polyamine polyacetic acids, and the amine or polyamine polymethylenephosphonic acids.

Polyphosphoric acids are derived by heating the acid salts of phosphoric acid. In particular the monobasic sodium salt of orthophosphoric acid may be heated to form a glass that is highly soluble in water. Such a polyphosphate is variously called sodium polyphosphate or sodium hexametaphosphate. Other sodium polyphosphates are derived from combinations of monobasic and dibasic sodium phosphates that are heated in various ways. Potassium polyphosphates are manufactured by heating certain potassium acid salts of phosphoric acid. These materials are powerful chelating agents; however, they suffer from the fact that phosphates in general, are fertilizers, that is, nutrients for plant growth.

In the environment phosphates that were released, in part from household laundry products, led to the uncontrolled growth of algae in various lakes and streams in the United States. As a result phosphates have been banned by various government agencies. In addition they are no longer fashionable and are difficult to sell as part of a laundry product, at least in the United States. In addition phosphates are moderately expensive considering their effectiveness. Finally phosphates are not hydrolytically stable, especially in strongly alkaline, hot aqueous environments, such as may be found in a laundry tub. For these reasons polyphosphates are not preferred for purposes of this invention.

There is a series of compounds derived from the reaction of an amine or polyamine with formaldehyde and phosphoric acid. Ammonia, for example, when so reacted forms nitrilotrimethylenephosphonic acid. Such a material when properly neutralized (ie. pH 10, for example) is useful for purposes of this invention. Similar compounds derived from ethylenediamine, hydroxyethylethylenediamine and so forth, again reacted with formaldehyde and phosphoric acid, are all useful. Such materials tend to be more expensive than more common agents, and, though effective and available, are not widely used, at least in soaps or cosmetics. These compounds are stable against hydrolysis.

These agents, the polyaminepolymethylenephosphonic acids are somewhat expensive and do not really solve the problem of the prejudice against phosphate use in laundry detergent systems. Because of their cost, such compounds have been restricted to uses that take advantage of their unusual ability to prevent crystal growth at very low concentrations. These materials are not preferred for purposes of this invention.

There are a series of materials formed from the reaction of an amine or polyamine with formaldehyde and sodium cyanide. Such materials presently are made by either of two procedures. In one of these methods an alkali cyanide is reacted with formaldehyde and a polyamine, such as, for example, ethylenediamine. The alkali metal salt of, in this case, ethylenediaminetetraacetic acid is formed directly along with ammonia.

In the second procedure hydrogen cyanide is reacted directly with formaldehyde in acid solution in the presence of the desired amine and the cyano compound is formed. This latter material is not soluble and can be easily separated from the reaction mix, and, incidentally, purified. The cyano compound is then hydrolyzed to the acetic acid compound with the release of ammonia by interaction with the appropriate alkali metal hydroxide. Since this route yields a purer product and has slightly less expensive feedstocks, it is preferred, at least when made in a properly equipped plant.

Many amines can be used for this reaction. In the United States materials made from ethylenediamine, from diethylenetriamine, and ammonia are all available commercially. Of these, the material made from ammonia is called nitrilotriacetic acid and is both highly effective, when used with soap, and low-cost. Because NTA has the lowest molecular weight of the polyaminepolyacetic acids, it is the most effective on a pound-for-pound basis. The feedstock for NTA uses only cyanide, alkali, and formaldehyde, since (as mentioned above) ammonia is generated from the reaction.

Surprisingly, when NTA is used in a detergent system based upon soap, the NTA acts upon released dirt to prevent redeposition of the dirt upon the clothes. Though not all alternatives of the polyaminepolyacetic class of chelating agents have been tested, NTA appears to be singularly effective in this regard. In general, the polyaminepolyacetic acids are the preferred chelating agents for purposes of this invention. Of these materials NTA is the most preferred because of its cost, effectiveness, and action to prevent redeposition.

About twenty years ago NTA, was proposed as a chelating agent to be used with syndet-based laundry detergents. Some initial toxicity testing regarding certain toxic metal chelates of NTA seemed to point to health problems with the material. Since that time extensive studies have shown no problem with the product and it currently is used in Switzerland, Holland, and Canada in syndet-based laundry detergent systems. Presently NTA has been approved for use in the United States for laundry detergents. When used in formulations that come under various Federal and State labeling and right to know laws, NTA must be identified in the product, and appropriate warnings given.

The level of chelating agent required in a laundry detergent relates to the level of hardness expected in water, the amount of detergent used with a load of laundry, and the molecular structure of the chelating agent involved. In the United States, average water hardness is only the equivalent of 90 parts per million of calcium carbonate. Eighty percent of all U.S. water supplies have hardness of less than 150 parts per million.

In the U.S. an average washing machine has a capacity for a medium load of about fifty liters of water. The required amount of trisodium NTA monohydrate (the form available commercially) to chemically soften water of 150 parts per million of equivalent calcium carbonate average hardness is about 21 grams.

In Europe hardness levels are closer to two hundred. In Japan levels of hardness average only 25 parts per million. In Europe washing machines have washing chambers that are smaller than the U.S. (front loading designs) so that detergent systems need actually have less chelating agent per wash since less water is softened is spite of the fact that the water is generally harder. In Japan, washers are more like those in the U.S. but generally physically smaller. In Europe, similar formulations to the U.S. are effective. In Japan relatively less NTA per load is required so that the proportion of NTA in a detergent system might be cut by a factor of three.

Only about two thirds of the weight of NTA compared to EDTA is required to deal with the same level of hardness. With sodium tripolyphosphates, comparable levels to EDTA are desirable. In the case of tetrapotassium pyrophosphate almost three times as much material is required as with trisodium NTA monohydrate.

I have found that in truly soft water such as is achieved with one mole equivalent of NTA, remarkably little tallow soap is required to clean clothes, typically only about 100 parts per million. In the case of an average washing machine in the U.S. such a level corresponds to only about five grams per medium load.

A typical formulation suitable for the U.S. and Europe, neglecting any perfumes and such, might have 21 grams of trisodium NTA, monohydrate, seven grams of tallow soap powder, and one third gram of sodium silicate. Two tablespoons full containing about one ounce by weight would suffice for a medium load of laundry in the U.S. This level is half that of the most concentrated present day laundry powders based upon syndets. Since this level suffices for 150 ppm hardness, less hard water could use even less of this powder and achieve satisfactory performance.

In Europe, with front loading, lower water capacity washers, but harder water about the same use per wash might suffice. In Japan the ratio of trisodium NTA monohydrate to soap might best be changed to about one to one and only about one half to two thirds a tablespoon should be more than adequate per load of laundry.

The teachings of this invention may be illustrated through the following examples.

EXAMPLE 1

Lux brand bar bath soap was purchased from Kroger Grocery in Dayton, Ohio, and was grated using the fine side of an ordinary kitchen grater to give one pound of soap powder. This powder was mixed with 772 grams of "Hampshire NTANa3" trisodium NTA, monohydrate, from Hampshire Chemical Corp., of Lexington, Mass. The resulting white powder was tested by putting one level tablespoon of the mixture in a General Electric home washer set on ordinary cycle, cold wash and cold rinse, and extra large load. The tablespoon measured 14 grams by weight. The input water to the washer was softened Dayton, Ohio, water. The washing machine was activated and the water tested at intervals of one minute. After three minutes no particles of soap could be detected in the wash water and the wash water was completely transparent. This transparency was taken to mean that the water was completely soft. Otherwise the water would have been cloudy from precipitated soap particles. The action of the washer produced moderate foam in the machine (about two inches high).

EXAMPLE 2

One tablespoon of the soap prepared in Example 1 was again added to the washing machine of example 1 using the same washer settings. This time, however, the machine was run with a full load of ordinary household laundry. Only light foaming was noted during the wash cycle. After washing and drying, using no bleach or softeners, the clothes were examined and found to be soft and clean and easily folded. No static cling was noted with fabrics normally subject to the problem.

EXAMPLE 3

A clean white 100% cotton twin bed sheet was purchased from J. C. Penney in Dayton, Ohio, and washed twice using Tide detergent from Procter &. Gamble Company of Cincinnati, Ohio. The sheet was then dried. The sheet was cut in half and each half given an identifying mark. Each half was washed in a standard General Electric washing machine using normal cycle, cold wash and rinse water, and medium load in wash water to which 10 grams of Elftex 8 carbon black powder from Cabot Chemical Company of Boston, Mass., had been added. During the washing one of the half sheets had Tide detergent from Procter & Gamble added in accord with directions on the package. The other half used two tablespoons of the detergent system prepared in Example 1. After washing, it was found the Tide washed material lost 17.1 units of brightness as measured by a standard Launderometer while the half washed with the material prepared in Example 1 had a brightness loss of 10.6 units. The difference in color of the two sheets could easily be detected by eye. This result is taken as indicative that redeposition of soil is more than adequately prevented by the detergent systems of this invention.

EXAMPLE 4

The experiment of Example 3 was repeated using yet a third half sheet similarly prepared. In this experiment, however, 7 grams of soap powder, and 21 grams of tetrasodium EDTA from Aldrich Chemical Company of Milwaukee, Wis., was used as the detergent system. In this instance, the brightness units lost were 15.2, which was taken to indicate the redeposition of the trisodium NTA, was superior to that of EDTA.

EXAMPLE 5

One kilogram of Anar Chemical Co.,(of Addison, Ill.) Anar 45 soap powder was mixed with three kilograms of Hampshire NTANa3. This mixture was furnished to Patterson Park Laundromat of Dayton, Ohio for trial. Ordinarily Patterson Park Laundromat does about 50 loads of wash per day on a full service basis, that is, the employees of the laundromat wash and dry the clothes for customers and return the completed folded laundry to them. The trial was run for two days. The company reported that they could obtain clothes whiter than normal with no use of bleach. Furthermore no softening agents at all were required with the clothes and it was reported that they folded better than normal. On this basis the laundromat made plans to convert completely to the new system, requesting only that some scent be added to make the laundromat have a pleasent odor.

What is claimed is:

1. A laundry detergent consisting of 40–95% by weight of sodium nitrilotriacetic acid, monohydrate, anhydrous, or mixtures thereof; 5–60% by weight of the alkali metal, amino alcohol, or alkanolamine monocarboxylates of fatty acids containing about C6 to C22 carbon atoms; and optionally, 0–55% by weight of perfumes, dyes, bleaches or inorganic water salts selected from the group consisting of sodium silicate, sodium sulfate, sodium chloride, sodium carbonate, and mixtures thereof.

* * * * *